US011738283B2

(12) United States Patent
Moon

(10) Patent No.: US 11,738,283 B2
(45) Date of Patent: Aug. 29, 2023

(54) CHILDREN'S PUSH SNOWBLOWER TOY

(71) Applicant: Anna Moon, Oshkosh, WI (US)

(72) Inventor: Anna Moon, Oshkosh, WI (US)

( * ) Notice: Subject to any disclaimer, the term of this patent is extended or adjusted under 35 U.S.C. 154(b) by 39 days.

(21) Appl. No.: 17/475,175

(22) Filed: Sep. 14, 2021

(65) Prior Publication Data

US 2023/0082490 A1 Mar. 16, 2023

(51) Int. Cl.
*A63H 33/30* (2006.01)
*A63H 5/00* (2006.01)

(52) U.S. Cl.
CPC ..... *A63H 33/3072* (2013.01); *A63H 5/00* (2013.01); *A63H 33/30* (2013.01)

(58) Field of Classification Search
CPC .. A63H 33/007; A63H 33/30; A63H 33/3072; A63H 5/00
See application file for complete search history.

(56) References Cited

U.S. PATENT DOCUMENTS 2,781,609 A * 2/1957 Allen ..... A63H 33/30 446/144
4,104,812 A * 8/1978 Stribiak, Jr. ..... E01H 5/04 37/243
4,295,294 A * 10/1981 Rosenwinkel ..... A63H 33/32 446/144
6,865,868 B2 * 3/2005 Moshi ..... A01D 42/00 56/2
6,941,739 B1 * 9/2005 Gliser ..... A01D 42/00 37/244
7,806,747 B2 * 10/2010 Duncan ..... A63H 7/02 446/411
2003/0221403 A1 * 12/2003 Hancock ..... A01D 43/063 56/202
2006/0217028 A1 * 9/2006 Duncan ..... A63H 7/02 446/280

* cited by examiner

*Primary Examiner* — John A Ricci
(74) *Attorney, Agent, or Firm* — Lyman Moulton, Esq.; Moulton Patents, PLLC

(57) ABSTRACT

The children's push snowblower toy provides children with a transformable toy feature that safely mimics a real-life snow blower in order to enhance a child's playing experience in the snow. The children's push snowblower toy introduces a two-in-one toy that serves as a lawn mower and possesses an attachment that connects onto a toy lawnmower to transform it into a toy snow blower. This toy can be assembled by the parents with ease and creates a thrilling outdoor activity for children while playing in the snow. It mimics the movement and sounds of an actual blower and has moving parts, such as the snow-chute that swivels 180 degrees by a crank, and a chute, adjustable by hand.

9 Claims, 3 Drawing Sheets

CHILDREN'S PUSH SNOWBLOWER TOY

BACKGROUND

A snow blower or snow thrower is a machine for removing snow from an area where it is problematic, such as a driveway, sidewalk, roadway, railroad track, ice rink, or runway. The commonly used term "snow blower" is a misnomer, as the snow is moved using an auger or impeller instead of being blown (by air). It can use either electric power (line power or battery), or a gasoline or diesel engine to throw snow to another location or into a truck to be hauled away. This is in contrast with the action of snow plows, which push snow to the front or side. Typically, the snow is discharged to one side.

SUMMARY OF THE INVENTION

The main purpose of the children's push snowblower toy is to provide users with an interchangeable children's toy lawn mower with snow blowing features. Searching for new fun toys for kids can be a time-consuming and troublesome process for many parents and/or caregivers. In the winter seasons, especially, creating or finding new activities for children can be particularly difficult as there is a lack of toys available in the market that are specifically designed for engaged play during colder climates.

The children's push snowblower toy provides children with a transformable toy feature that safely mimics a real-life snow blower in order to enhance a child's playing experience in the snow. Expanding on the initial design of an adult-operated lawn mower, the children's push snowblower toy introduces a novel two-in-one toy that serves as a lawn mower and possesses an attachment that conveniently and easily connects onto toy lawnmower to transform it into a snow blower. This unprecedented toy can be assembled by the parents with great ease, and creates a thrilling outdoor activity for children while playing in the snow. It mimics the movement and sounds of an actual blower and has moving parts, such as the snow-chute that swivels 180 degrees by a crank, and a chute, adjustable by hand. The children's push snowblower toy ensures a fully operational, lively toy that is specifically designed for colder temperatures, but can also be used in all climes.

Figure 1:
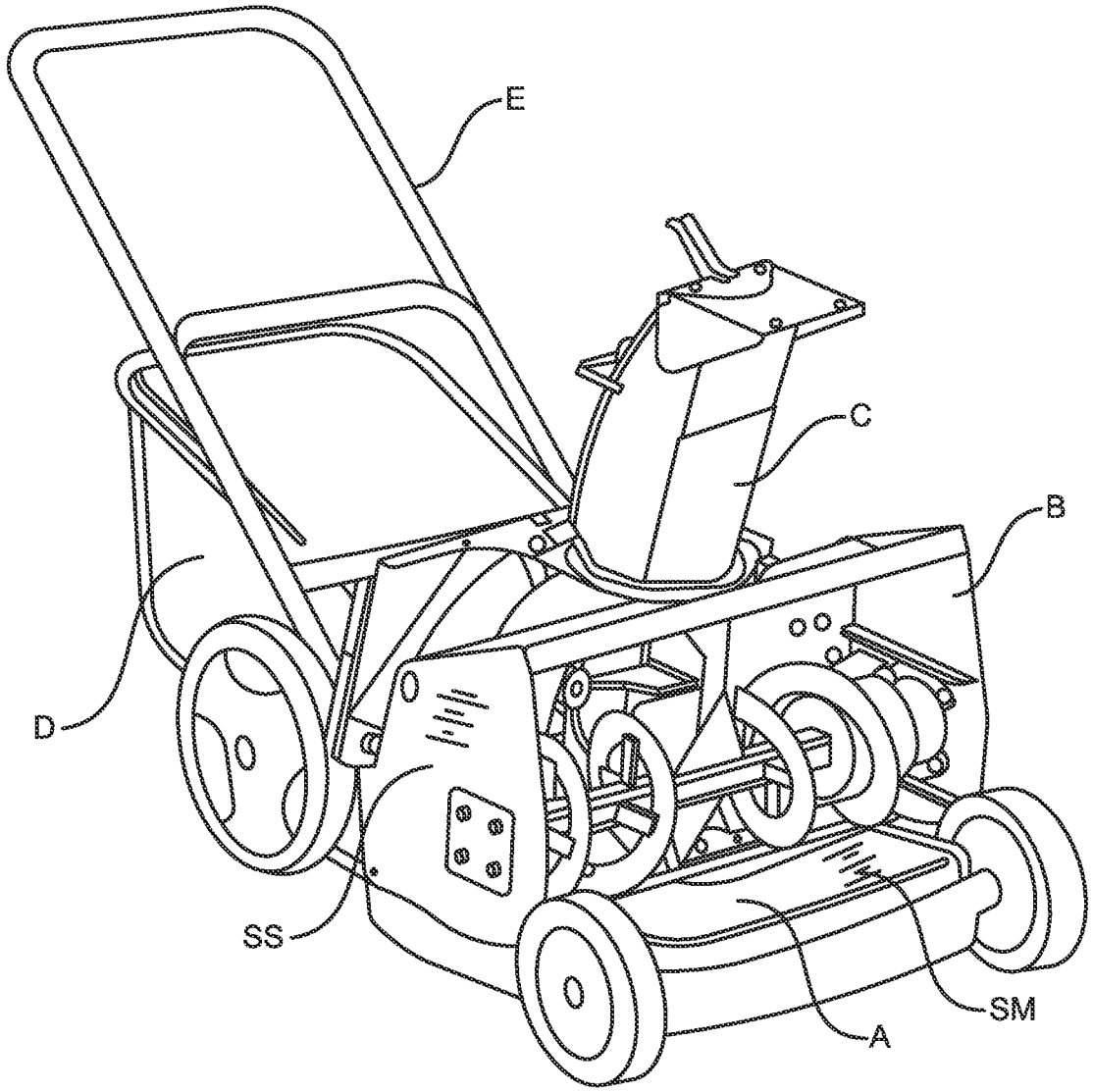
FIG. 1 is a perspective view of the children's snowblower toy in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a perspective view of the children's snowblower toy in accordance with an embodiment of the present disclosure. Reference A depicts the base toy lawnmower, which the snow blower attachment is placed upon. Reference B depicts the snow blower attachment, which connects to the toy push lawnmower. Reference C depicts the adjustable snow chute and reference D depicts the lawn mower grass catch and adjustable handle E.

Figure 2:
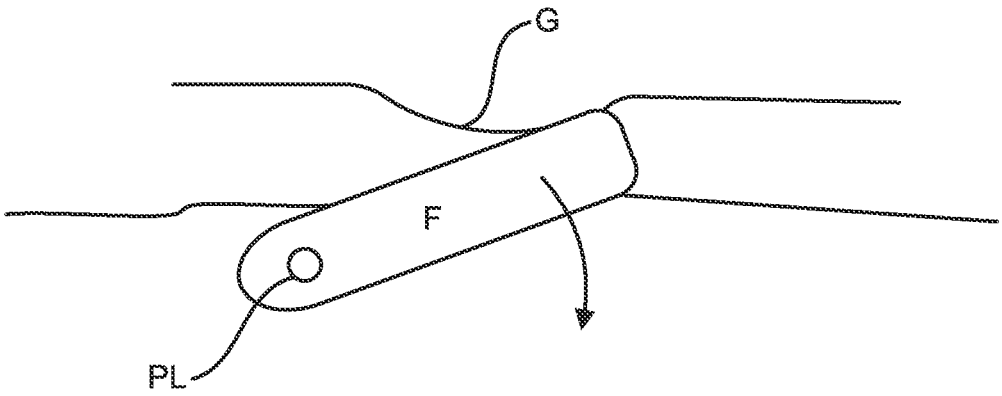
FIG. 2 depicts a sound generation switch in accordance with an embodiment of the present disclosure.

FIG. 2 depicts a sound generation switch in accordance with an embodiment of the present disclosure. Reference F depicts a switch F which pivots on pivot P1 and activated by boss G to activate a sound generation of the lawn mower when undepressed or the snow blower when depressed.

Figure 3:
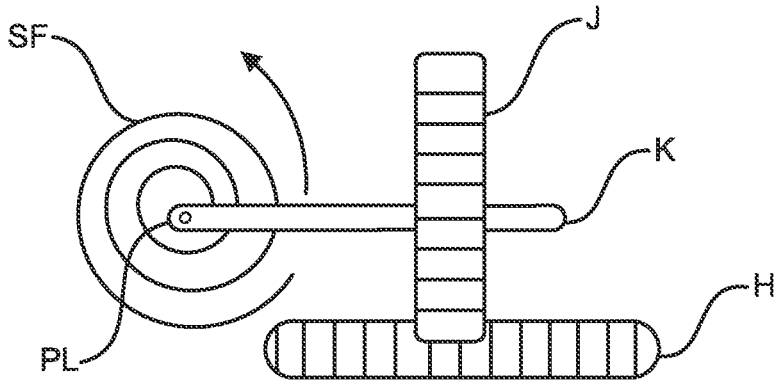
FIG. 3 depicts a gear box in accordance with an embodiment of the present disclosure.

FIG. 3 depicts a gear box in accordance with an embodiment of the present disclosure. The reference H is a first gear in a universal gear box which is turned based on the second gear J which turns on an axle K which in turns pivots on P2 in order to provide a fail safe by disengaging with the first gear H and to stop a lawn mower blade attached thereto or to stop a snow blower auger attached thereto. The failsafe of axle K is activated by a resistance on either of the lawn mower blade or the snow blower auger blade and is spring loaded by spring SF to reengage when the resistance is removed. The spring constant is set to allow a disengagement based on a torque force equal to a preset force safe to child operators. Speaker SS projects a snow blowing mimic sound and speaker SM, depicted in FIG. 1, projects a lawn mowing mimic sound based on respective sound generators attached there behind.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A children's toy comprising:

a lawn mower base having a speaker, a grass catch and a handle;

a snow blower attachment having a snow chute, wherein the snow blower is attachable to the lawn mower base; and a switch, on the lawn mower base, configured to choose one of a lawn mower mimic sound and a snow blower mimic sound to project via the speaker.

2. The children's toy of claim 1, wherein the grass catch is detachable from the lawn mower base.

3. The children's toy of claim 1, wherein the handle enables a push operation of the lawn mower and the snow blower.

4. The children's toy of claim 1, wherein the snow chute is rotatable by hand.

5. The children's toy of claim 1, further comprising a sound generator to mimic the sound of a lawn mower cutting grass.

6. The children's toy of claim 1, further comprising a sound generator to mimic the sound of a snow blower blowing snow.

7. The children's toy of claim 1, further comprising a boss on the snow blower attachment which depresses a switch on the lawn mower to disable a lawn mower blade.

8. The children's toy of claim 1, further comprising a boss on the snow blower attachment which depresses a switch on the lawn mower to disable a lawn mower mimic sound.

9. The children's toy of claim 1, further comprising a default switch on the lawn mower which undepressed enables a lawn mower mimic sound to project from a speaker on the lawn mower.

* * * * *